US005145358A

United States Patent [19]

Shike et al.

[11] Patent Number: 5,145,358

[45] Date of Patent: Sep. 8, 1992

[54] SAFETY DEVICE FOR PIEZOELECTRIC GAS LIGHTER

[75] Inventors: Tsutomu Shike; Toshihiko Eguchi; Nobuo Yamazaki, all of Shizuoka, Japan

[73] Assignee: Tokai Corporation, Kanagawa, Japan

[21] Appl. No.: 797,300

[22] Filed: Nov. 25, 1991

[30] Foreign Application Priority Data

Nov. 30, 1990 [JP] Japan ..... 2-130581

[51] Int. Cl.[5] ..... F23D 11/36

[52] U.S. Cl. ..... 431/153; 431/255; 431/277

[58] Field of Search ..... 431/153, 254, 255, 276, 431/277

[56] References Cited

U.S. PATENT DOCUMENTS 3,898,031 8/1975 Rusakowicz .
4,784,601 11/1988 Nitta ..... 431/277
4,784,602 11/1988 Nitta .
4,786,248 11/1988 Nitta .
4,832,596 5/1989 Morris, Sr. .
4,859,172 8/1989 Nitta .
5,002,482 3/1991 Fairbanks et al. .
5,090,893 2/1992 Floriot ..... 431/276

FOREIGN PATENT DOCUMENTS 62-180244 11/1987 Japan .
62-180247 11/1987 Japan .
63-142562 9/1988 Japan .
1-178456 12/1989 Japan .
3-25215 2/1991 Japan .
3-501647 4/1991 Japan .

*Primary Examiner*—Carroll B. Dority
*Attorney, Agent, or Firm*—Brumbaugh, Graves, Donohue & Raymond

[57] ABSTRACT

A piezoelectric gas lighter has an actuator cap which is mounted on an upper part of a lighter body to be movable up and down between upper and lower positions relative to the lighter body and is urged to the upper position. The actuator cap is depressed toward the lower position to discharge fuel gas stored in a reservoir provided in the lighter body and to actuate an ignition mechanism to ignite the fuel gas. A safety device for the piezoelectric gas lighter includes a projection which is provided on said upper part of the lighter body, a stopper member which is mounted on said actuator cap so that it can be movable relative to the actuator cap along a linear path between a locking position where a part of the stopper member is aligned with the projection and interferes with the projection to prevent downward movement of the actuator cap and a releasing position where said part of the stopper member is out of alignment with said projection and permits downward movement of the actuator cap and so that the actuator cap can be depressed by pushing downward the stopper member, and a spring which urges the stopper member to the locking position. The projection has a vertical surface which extends downward facing toward the releasing position of the stopper member and the vertical surface holds the stopper member in the releasing position when the actuator cap is below said upper position.

5 Claims, 4 Drawing Sheets

SAFETY DEVICE FOR PIEZOELECTRIC GAS LIGHTER

BACKGROUND OF THE INVENTION

1. Field of the Invention

This invention relates to a safety device for a piezoelectric gas lighter, and more particularly to a safety device for a piezoelectric gas lighter which prevents depression of an actuator cap of the lighter to prevent inadvertent ignition while the gas lighter is not used.

2. Description of the Prior Art

The piezoelectric gas lighter has an actuator cap which is mounted on an upper part of the lighter body to be movable up and down, and when the actuator cap is depressed, fuel gas is discharged and an ignition mechanism is actuated to ignite the fuel gas. Though the gas lighter is a convenient tool which can easily be ignited by depression of the actuator cap, it is not preferable in view of safety that those who do not know proper use of the lighter like a child inadvertently ignites it.

Accordingly, there has been a demand for a so-called child resistant gas lighter which cannot be inadvertently ignited by children or the like.

There have been proposed various kinds of child resistant gas lighter. Most of the safety devices built in these child resistant gas lighter have a lock mechanism which prevents depression of the ignition lever and must be released to allow the ignition lever to be depressed. However, any type of the conventional child resistant gas lighter has drawbacks in use and is desired to be improved for practical use.

For example, any one of the safety devices as disclosed in Japanese Unexamined Utility Model Publication Nos. 62(1987)-180244, 62(1987)-180247 and 63(1988)-142562, and U.S. Pat. Nos. 4,859,172, 4,786,248 and 4,784,602 has a lock member which prevents depression of the ignition lever. The lock member is manually moved between a locking position and a releasing position, and the lock member remains in the releasing position and the safety device cannot function unless the lock member is manually returned to the locking position after it is moved to the releasing position and the gas lighter is ignited. That is, the lock mechanism must be operated again after it is released and the lighter is used. Otherwise, the lock mechanism cannot function. Thus there has been a demand for a further improved lock mechanism.

There has been proposed a safety device having a so-called auto-return function for automatically returning the lock member (which prevents depression of the ignition lever) to the locking position in response to the igniting operation of the gas lighter after movement of the lock member to the releasing position. For example, those disclosed in U.S. Pat. Nos. 5,002,482 and 3,898,031, and Japanese Unexamined Patent Publication No. 3(1991)-25215 have such an auto-return function. However, either of these safety devices has drawbacks for practical use that release of the lock mechanism involves a motion of a finger along an L-shaped path, which adversely affects ease of releasing the lock mechanism in the gas lighter which is generally operated with a single finger, e.g. the thumb, and leads to different results depending on persons who use the lighter. Further, in the safety device disclosed in the former patent publication, the lock member is formed of resilient material and accordingly, the lock member can return to the locking position under its own resiliency after it is moved to the releasing position.

Though there have been proposed safety devices in which the lock mechanism is released by a motion of a finger along a path in the form of a simple line. not L-shaped, any one of them has drawbacks for practical use. For example, in the safety device disclosed in Japanese Patent Publication of Translated Version (PCT) No. 3(1991)-501647, a part of a lock member which is formed of spring is moved along an arcuate path to the releasing position and held there. However, in the safety device, the arrangement for guiding release of the spring-like lock member is not satisfactory and accordingly the lock member cannot be steadily released, which adversely affects ease of releasing the lock mechanism in the gas lighter which is generally operated with a single finger, e.g. the thumb, and leads to different results depending on persons who use the lighter as in the preceding example. Further, since the lock member is formed of spring, the lock member can deform to cause failure of the lock mechanism after repeated use of the lighter.

In the safety device disclosed in U.S. Pat. No. 4,832,596, the lock member is moved along a linear path to the releasing position but it automatically returns to the locking position unless it is held with a finger other than the finger with which the ignition mechanism is actuated. Accordingly, in the safety device, the lock member cannot be steadily released, which adversely affects ease of releasing the lock mechanism in the gas lighter which is generally operated with a single finger, e.g. the thumb, and leads to different results depending on persons who use the lighter as in the preceding examples.

In order to overcome such problems, there has been proposed an auto-return safety device in which the lock member is moved along a linear path to the releasing position, thereby facilitating release of the lock mechanism, and at the same time, it can be held in the releasing position with the finger with which the ignition mechanism is actuated, without using another finger. However, the safety device also has drawbacks for practical use. That is, in the safety device disclosed in the Japanese Unexamined Utility Model Publication No. 1(1989)-178456, the lock member is incorporated in the ignition lever, which is actuated to ignite the lighter, so that the lock member can be moved to the releasing position with the thumb for operating the ignition lever, and the ignition lever is actuated with the thumb after the lock member is moved to the releasing position with the thumb. Thus in the safety device, release of the lock mechanism is facilitated. However, the safety device is disadvantageous in that when the ignition lever is actuated with the thumb after the lock member is moved to the releasing position with the same finger, the lock member can be inadvertently released from the thumb and can return to the locking position. Accordingly, also in the safety device, the lock member cannot be steadily released, which adversely affects ease of releasing the lock mechanism in the gas lighter which is generally operated with a single finger, e.g. the thumb, and leads to different results depending on persons who use the lighter as in the preceding examples.

As can be understood from the description above, any one of the conventional child resistant safety device has drawbacks for practical use, and accordingly there has been a demand for a child resistant safety device which has an enhanced safety and is easy to handle.

SUMMARY OF THE INVENTION

In view of the foregoing observations and description, the primary object of the present invention is to provide a safety device for a piezoelectric gas lighter which is excellent both in ease of handling and in safety function and which has an auto-return lock mechanism which can be automatically restored without operation after it is released and the lighter is ignited.

In accordance with the present invention, there is provided a safety device for a piezoelectric gas lighter having an actuator cap which is mounted on an upper part of a lighter body to be movable up and down between upper and lower positions relative to the lighter body and is urged to the upper position, the actuator cap being depressed toward the lower position to discharge fuel gas stored in a reservoir provided in the lighter body and to actuate an ignition mechanism to ignite the fuel gas, said safety device comprising a projection which is provided on said upper part of the lighter body, a stopper member which is mounted on said actuator cap so that it can be movable relative to the actuator cap along a linear path between a locking position where a part of the stopper member is aligned with the projection and interferes with the projection to prevent downward movement of the actuator cap and a releasing position where said part of the stopper member is out of alignment with said projection and permits downward movement of the actuator cap and so that the actuator cap can be depressed by pushing downward the stopper member, an urging means which urges the stopper member to the locking position, and a holding means which holds the stopper member in the releasing position when the actuator cap is below said upper position.

In the safety device in accordance with the present invention, the stopper member prevents depression of the actuator cap and does not permit inadvertent ignition of the lighter while the gas lighter is not used, and at the same time, it is automatically returned to the locking position after it is moved to the releasing position to permit ignition and the actuator cap returns to the original position after ignition. Thus a highly safe gas lighter having an auto-return function in which the lock mechanism is automatically restored without operation after it is released and the lighter is ignited can be realized.

Further, in the gas lighter in accordance with the present invention, since the stopper member is linearly moved between the locking position and the releasing position, it can be easily operated.

DESCRIPTION OF THE PREFERRED EMBODIMENT

In FIGS. 1 to 9, a top portion 1 of a lighter body has a recess 100 and an actuator cap 2 is slidably received in the recess 100 to be moved downward into the recess 100 and upward out of the recess 100. The actuator cap 2 is urged upward by a spring (not shown). When the actuator cap 2 is depressed into the recess 100, fuel gas stored in a reservoir (not shown) provided in the lighter body is discharged and at the same time, a piezoelectric ignition mechanism (not shown) which is also provided in the lighter body is actuated to ignite the fuel gas.

A semi-cylindrical projection la is formed on the top portion 1 to project inward of the recess 100, and a stopper member 3 is mounted on the actuator cap 2 to be movable between a locking position (FIG. 1) where it abuts against the projection la and prevents depression of the actuator cap 2 and a releasing position (FIG. 2) where it does not interfere with the projection la and permits depression of the actuator cap 2.

Figure 1:
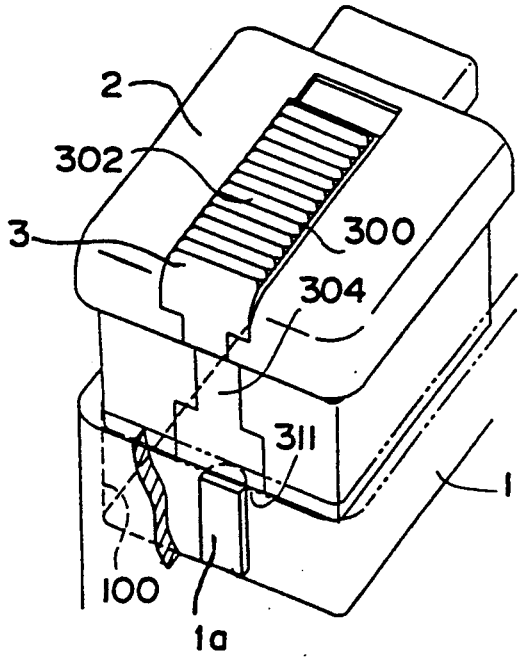
FIG. 1 is a perspective view showing an important part of a safety device in the locking state in accordance with an embodiment of the present invention.
Figure 6:
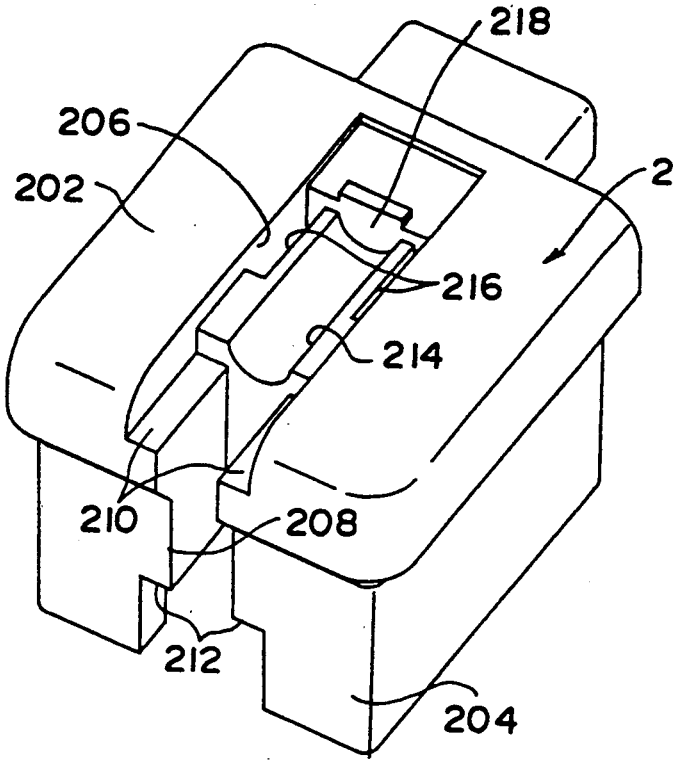
FIG. 6 is a perspective view showing the actuator cap.
Figure 7:
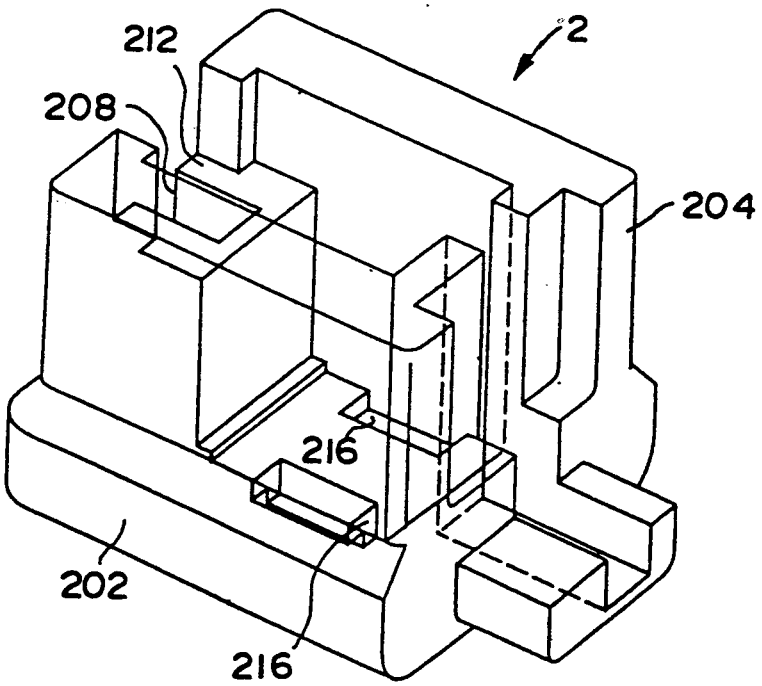
FIG. 7 is a perspective view of the actuator cap as viewed from below.

As shown in FIGS. 6 and 7 comprises a head portion 202 and a leg portion 204 which extends downward from the head portion 202. The leg portion 204 is slightly smaller in size than the recess 100 of the top portion 1 of the lighter body and is slidably received in the recess 100 while the head portion 202 is larger than the leg portion 204 and is substantially equal to the top portion 1 of the lighter body. A recess 206 is formed in the head portion 202 of the actuator cap 2 and a slit 208 is formed in the front side (the left side as seen in FIG. 1) to extend from the lower surface of the leg portion 204 to the upper surface of the head portion 202. The upper end of the slit 208 is smaller than the recess 206 in width, whereby a pair of shoulders 210 facing upward are formed on opposite sides of the upper end of the slit 208. The lower end portion of the slit 208 is enlarged to form a pair of shoulders 212 facing downward. A semi-cylindrical spring seat 214 is formed in the recess 206 behind the slit 208, and a pair of recesses 216 which are L-shaped in cross-section as clearly shown in FIG. 7 are formed on opposite sides of the spring seat 214. A spring retaining wall portion 218 is formed on the rear end of the spring seat 214.

Figure 4:
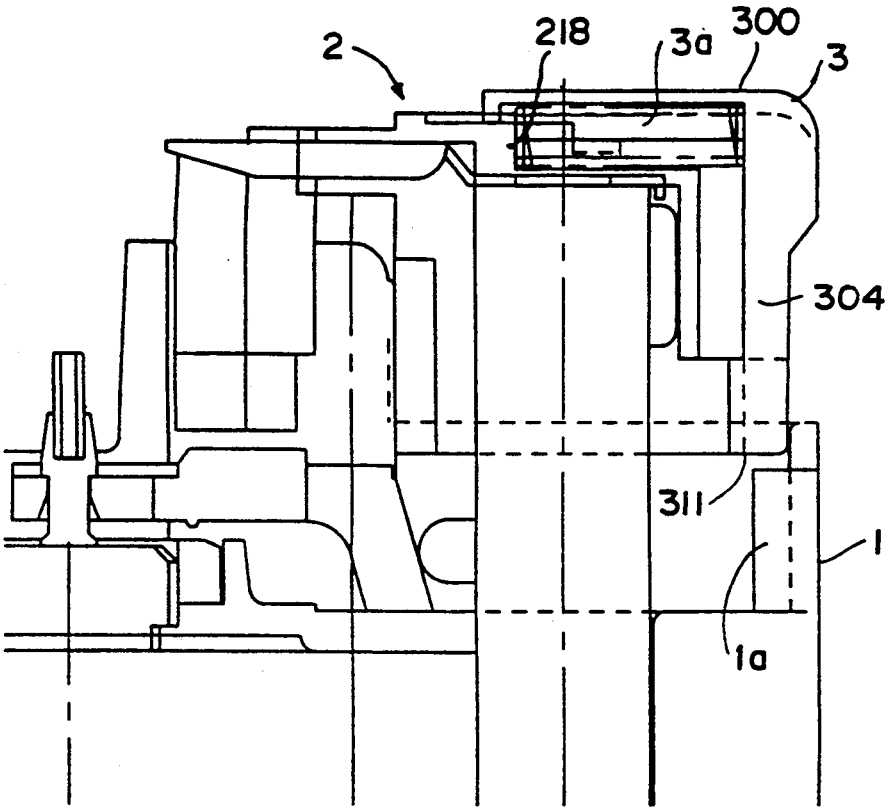
FIG. 4 is a side cross-sectional view showing the same in the locking position.
Figure 5:
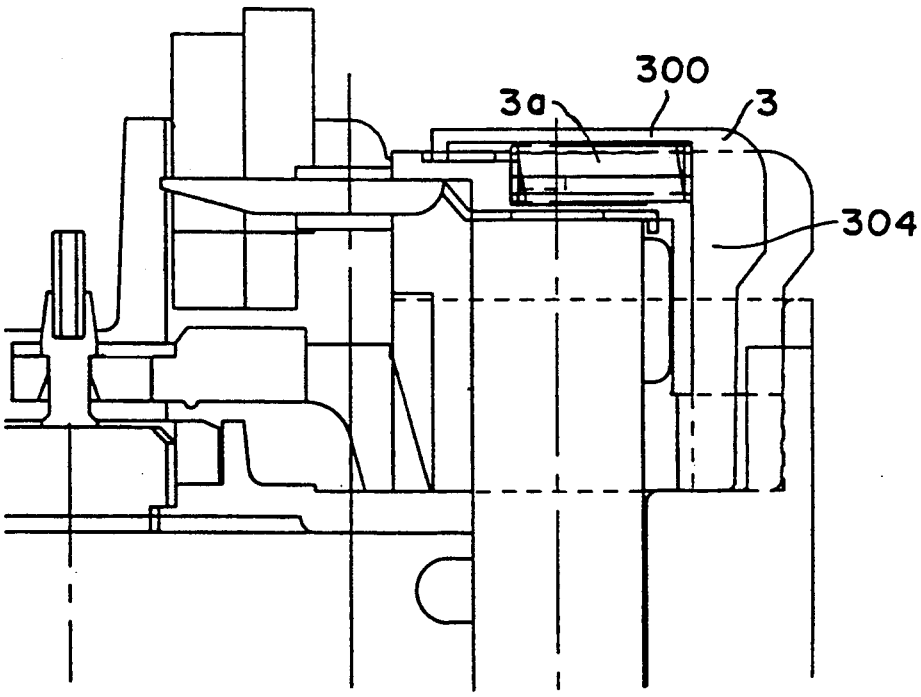
FIG. 5 is a side cross-sectional view showing the same with the actuator cap depressed.
Figure 8:
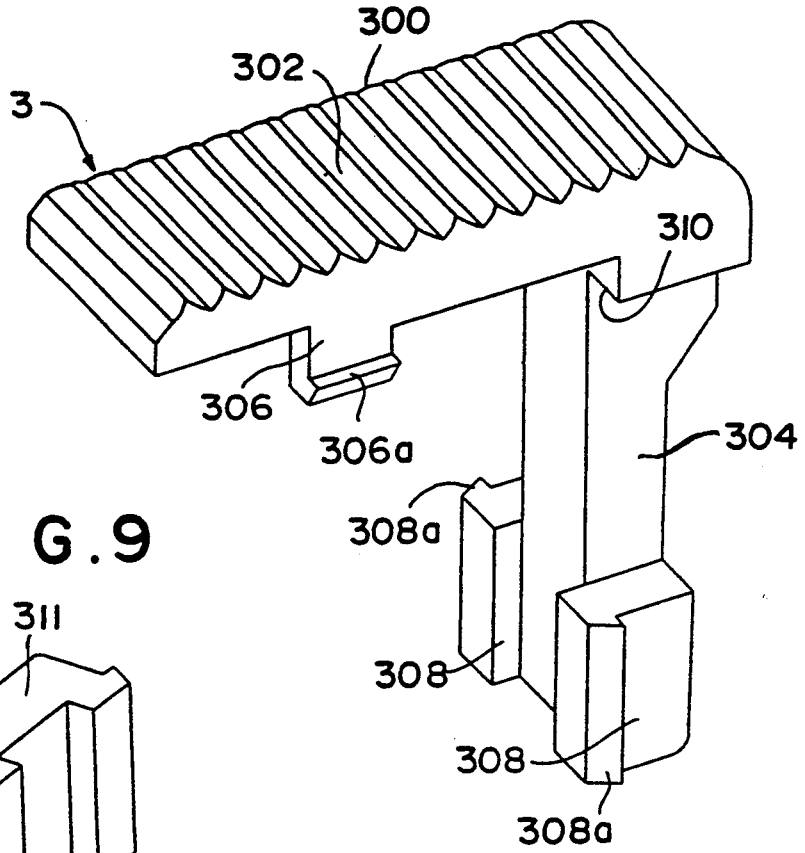
FIG. 8 is a perspective view showing the stopper member.
Figure 9:
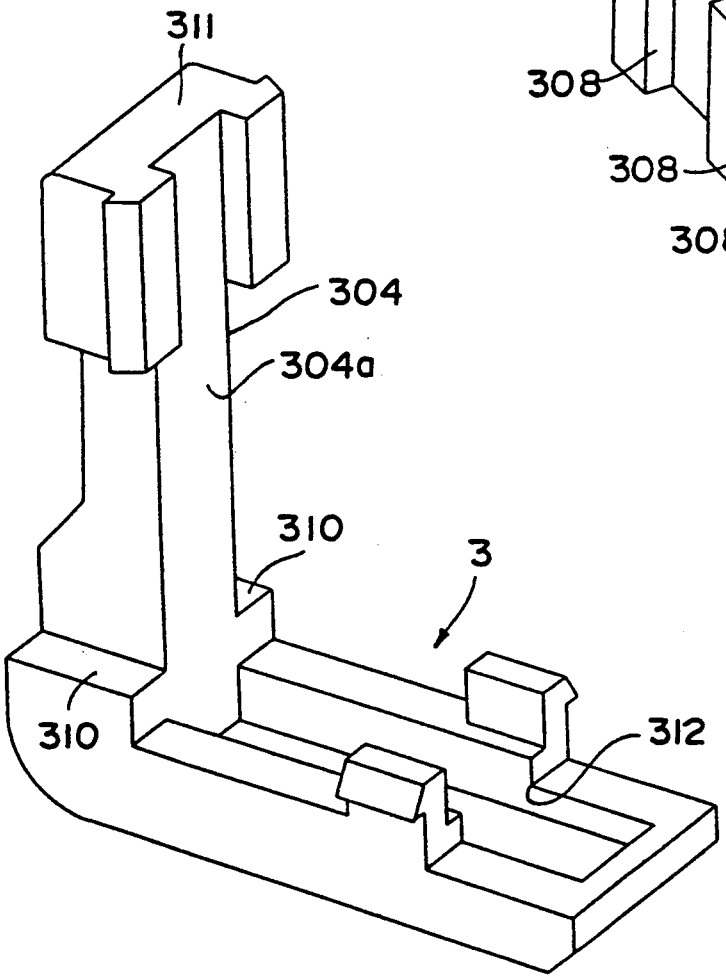
FIG. 9 is a perspective view of the stopper member as viewed from below.

As shown in FIGS. 8 and 9, the stopper member 3 comprises a head portion 300 which extends horizontally and has a knurled upper surface 302, and a leg portion 304 which extends downward from the front end of the head portion 300. A pair of tab portions 306 each having a barb portion **306*a* extends downward from the head portion 300 on opposite sides thereof. The leg portion 304 is smaller than the head portion 300 in width and a pair of shoulders 310 facing downward are formed on opposite sides of the leg portion 304. A pair of engagement portions 308 each having a barb portion 308*a* are provided on opposite sides of the lower end portion of the leg portion 304. Further, a recess 312 is formed on lower surface of the head portion 300 to accommodate a coil spring 3*a* placed on the spring seat 214 of the actuator cap 2 as shown in FIGS. 4 and 5**.

With the spring 3*a* placed on the spring seat 214 of the actuator cap 2, the stopper member 3 is incorporated in the actuator cap 2. When the stopper member 3 is incorporated in the actuator cap 2, the tab portions 306 of the stopper member 3 are forced into the recesses 216 of the actuator cap 2 and the engagement portions 308 are forced into the lower end portion of the slit 208 of the actuator cap 2. When the tab portions 306 are once forced into the recesses 216, the barb portion 306*a* of each tab portion 306 engages with the shoulder of the L-shaped recess 216, whereby the tab portions 306 are prevented from being drawn upward out from the recesses 213 though the tab portions 306 is permitted to slide along the recesses 216. Similarly when the engagement portions 308 are once forced into the lower end portion of the slit 208 of the actuator cap 2, the barb portions 308*a* of the engagement portions 308 engage with the rear face of the wall portions on opposite sides of the lower end portion of the slit 208, whereby the engagement portions 308 are prevented from being drawn out from the slit 208 though the engagement portions 308 are permitted to slide vertically along the slit 208. In this state, the coil spring 3*a* is compressed between the inner surface 304*a* of the leg portion 304 and the spring retaining wall portion 218, thereby urging the stopper member 3 to the locking position shown in FIG. 1, the shoulders 310 on opposite sides of the leg portion 304 rest on the shoulders 210 on opposite sides of the slit 208, the upper surfaces of the engagement portions 308 are opposed to 212 on opposite sides of the lower end portion of the slit 208, and the knurled upper surface 302 of the head portion 300 of the stopper member 3 is substantially flush with the upper surface of the head portion 202 of the actuator cap 2.

In the locking position, the lower surface 311 of the stopper member 3 abuts against the upper surface of the projection la and depression of the actuator cap 2 is prevented.

Figure 2:
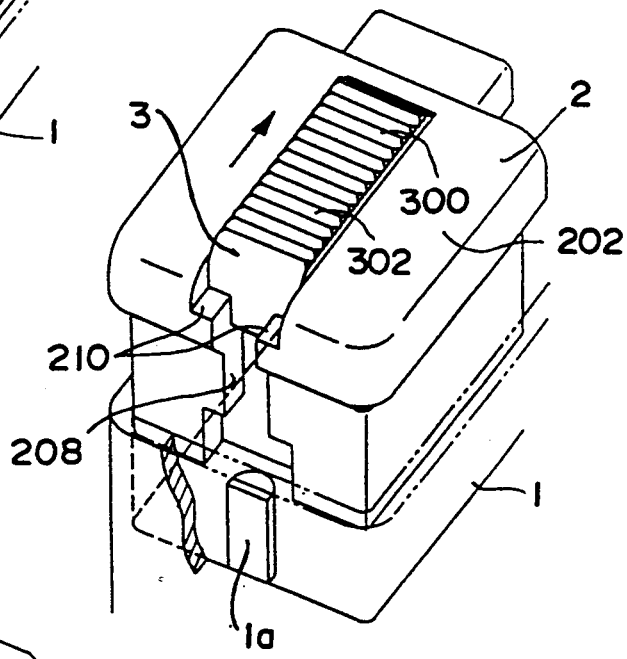
FIG. 2 is a perspective view showing the same but in the releasing position.
Figure 3:
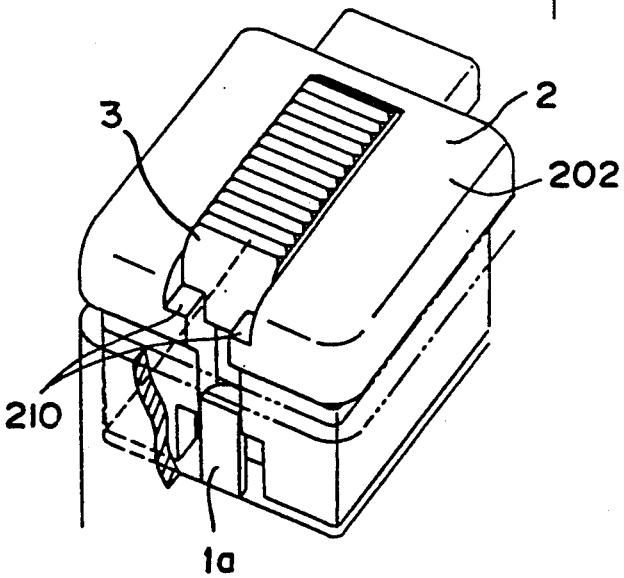
FIG. 3 is a perspective view showing the same but with the actuator cap depressed.

The stopper member 3 can be moved to the releasing position shown in FIG. 2 with the finger for depressing the actuator cap 2 overcoming the force of the spring 3*a*. In the releasing position, the leg portion 304 of the stopper member 3 is out of alignment with the projection 1*a*, and accordingly the stopper member 3 cannot interfere with the projection la even if the actuator cap 2 is moved downward and permits depression of the actuator cap 2 (See FIGS. 3 and 5).

When the actuator cap 2 is released after depression, the stopper member 3 is also released and is pushed toward the locking position by the spring 3*a*. However the stopper member 3 cannot return to the locking position until the actuator cap 2 completely returns to the original position since the leg portion 304 abuts against and slides on the inner surface of the projection 1*a*.

As the means for urging the stopper member 3 to the locking position, a plate spring or the like may be used instead of the coil spring 3*a*.

The operation of the safety device of this embodiment will be described in detail, hereinbelow.

While the lighter is not used, the stopper member 3 is held in the locking position shown in FIGS. 1 and 4 where it prevents depression of the actuator cap 2. In this state, ignition of the lighter is disabled and the lighter cannot be inadvertently ignited by children or the like.

When the lighter is used, the stopper member 3 is pushed to the releasing position shown in FIG. 2 by a finger. In the releasing position, the stopper member 3 does not interfere with the projection 1*a* and accordingly the actuator cap 2 can be depressed to discharge fuel gas and to actuate the piezoelectric ignition mechanism.

When the actuator cap 2 is released, the stopper member 3 tries to return to the locking position under the force of the spring 3*a* upon release of the actuator cap 2. However since the leg portion 304 of the stopper member 3 abuts against the inner surface of the projection 1*a*, the stopper member 3 cannot return to the locking position until the actuator cap 2 moves upward sufficiently high.

As can be understood from the description above, in the safety device of this embodiment, the stopper member 3 prevents depression of the actuator cap 2 and does not permit inadvertent ignition of the lighter while the gas lighter is not used, and at the same time, it is automatically returned to the locking position after it is moved to the releasing position to permit ignition and the actuator cap 2 returns to the original position after ignition. Thus a highly safe gas lighter having an autoreturn function in which the lock mechanism is automatically restored without operation after it is released and the lighter is ignited can be realized.

Needless to say, the embodiment described above is just an example and may be variously modified. For example, though, in the embodiment described above, the stopper member 3 is slidable back and forth (left and right in FIG. 4) relative to the actuator cap 2, it may be slidable in the transverse direction of the actuator cap 2.

Further though, in the embodiment described above, the projection la is semi-cylindrical in shape, it may be a rectangular prism, a triangular prism or the like. Further the projection la need not abut against the lower surface of the stopper member 3 but may abut against other part of the same such as a projection or a shoulder portion formed on the stopper member 3.

What is claimed is:

1. A safety device for a piezoelectric gas lighter having an actuator cap which is mounted on an upper part of a lighter body to be movable up and down between upper and lower positions relative to the lighter body and is urged to the upper position, the actuator cap being depressed toward the lower position to discharge fuel gas stored in a reservoir provided in the lighter body and to actuate an ignition mechanism to ignite the fuel gas, said safety device comprising a projection which is provided on said upper part of the lighter body and extends inwardly of said lighter body;

a stopper member which is slidably mounted on said actuator cap in an elongated cut-out portion intermediate opposite sides of said cap so that it can be movable relative to the actuator cap along a linear path between a locking position where a part of the stopper member is aligned with the projection and interferes with the projection to prevent downward movement of the actuator cap and a releasing position where said part of the stopper member is out of alignment with said projection and permits downward movement of the actuator cap and so that the actuator cap can be depressed by pushing downward the stopper member, an urging means which urges the stopper member to the locking position, and a holding means which holds the stopper member in the releasing position when the actuator cap is below said upper position.

2. A safety device as defined in claim 1 in which said stopper member has a leg portion which extends downward and the lower surface of the leg portion rests on the upper surface of said projection to prevent downward movement of the actuator cap.

3. A safety device as defined in claim 2 in which said holding means is an abutment surface which extends downward from the level of the upper surface of the projection facing toward the releasing position of the stopper member and on which the leg portion slides when the actuator cap is moved downward together with the stopper member with the stopper member in the releasing position.

4. A safety device as defined in claim 3 in which said projection has a vertical surface which extends downward facing toward the releasing position of the stopper member and said abutment surface comprises the vertical surface of the projection.

5. A safety device as defined in claim 4 in which said stopper member has a head portion which extends horizontally and said leg portion extends downward from the head portion and the head portion is slidably received in a recess formed on the upper surface of the actuator cap.

* * * * *